US005689894A

United States Patent [19]

Ebner

[11] Patent Number: 5,689,894

[45] Date of Patent: Nov. 25, 1997

[54] COOLING SYSTEM FOR ANNEALING MATERIAL CONTINUOUSLY MOVING ON A TRANSPORT MEANS

[76] Inventor: Peter Helmut Ebner, Bergham 168, A-4060 Leonding, Austria

[21] Appl. No.: 735,522

[22] Filed: Oct. 22, 1996

[30] Foreign Application Priority Data

Oct. 23, 1995 [AT] Austria ..... 1751/95

[51] Int. Cl.[6] ..... F26B 19/00

[52] U.S. Cl. ..... 34/86; 432/18

[58] Field of Search ..... 34/86; 432/18, 432/59, 152

[56] References Cited

U.S. PATENT DOCUMENTS

| | | | |
|---|---|---|---|
| 1,109,362 | 9/1914 | Richter | 432/18 |
| 1,294,804 | 2/1919 | Horst | 34/86 |
| 2,050,977 | 8/1936 | Smith et al. | 34/86 |
| 4,270,283 | 6/1981 | Ellis | 34/216 |

*Primary Examiner*—Henry A. Bennett
*Assistant Examiner*—D. Doster
*Attorney, Agent, or Firm*—Collard & Roe, P.C.

[57] ABSTRACT

A cooling system for annealing material (4) in the form of plates, strips or bulk material moving on a transport means (5) consists of a plurality of zones (1, 2, 3), in which the annealing material (4) is treated on its lower and/or upper surface with an oblique blast of cooling medium in the form of air or gas emerging from nozzles of nozzle bars (10, 10*a*, 10*b*) fed by a compressor-type blower (7, 8, 8*a*, 11). In order to reduce the required amount of cooling medium, and to reduce the technical effort involved, only the last zone (3) disposed on the outlet end for the annealing material (4) is connected to the supply (7) of pressurized fresh cooling medium. In this zone (3) a collecting fan (8, 11) is provided, which upon formation of the oblique blast urges the cooling medium into a distribution box (9). To the distribution box (9, 12) the nozzle bars (10) of the penultimate zone (2) are connected. This zone is likewise provided with a collecting fan (11) including distribution box (12) for the preceding zone (1). This set-up or arrangement is repeated up to the first zone (1) disposed on the inlet end for the annealing material (4), whose collecting fan (13) finally opens to the outside.

2 Claims, 1 Drawing Sheet

COOLING SYSTEM FOR ANNEALING MATERIAL CONTINUOUSLY MOVING ON A TRANSPORT MEANS

This invention relates to a cooling system for annealing material in the form of plates, strips or bulk material continuously moving on a transport means, where the cooling system comprises a plurality of zones in which the annealing material is treated on its lower and/or upper surface with an oblique blast of cooling medium in the form of air or gas emerging from nozzles of nozzle bars fed by a compressor-type blower.

Such oblique blast has a very high heat transfer capacity, where gas is used as protective gas whenever an undesired oxidation should be prevented. To this date, each of the zones of the system arranged one behind the other has its own compressor-type blower for forming the oblique blast, just as each of the zones has its own extraction fan leading to the outside. For cooling light-metal plates, for instance, air in an amount of about 15,000 $m^3/h$ at a temperature of about 30° C. is supplied to each of three zones, where the air is heated by about 10°–15° C. through the heat exchange with the annealing material and is then discharged to the outside. Since each zone of the system must be provided with fresh air, a relatively large amount of cooling medium is required, and the amount of apparatus involved is also correspondingly high.

It is therefore the object of the invention to eliminate these deficiencies and to improve the above-described cooling system such that a considerably reduced supply of fresh cooling medium is required, and the technical effort is also reduced.

This object is solved by the invention in that only the last zone disposed on the outlet end for the annealing material is connected to the supply of pressurized fresh cooling medium, and after the formation of the oblique blast a collecting fan is provided for the cooling medium, which urges the cooling medium into a distribution box, to which the nozzle bars of the penultimate zone are connected, which likewise has a collecting fan including distribution box of the preceding zone, where this set-up or arrangement is repeated up to the first zone disposed on the inlet end for the annealing material, whose collecting fan finally opens to the outside.

Since only the last zone disposed on the outlet end for the annealing material must be provided with fresh cooling medium, which under a corresponding exchange of energy is pushed through to the first zone, the desired considerable reduction of the required amount of annealing material is achieved, where in each zone of the system the temperature of the cooling medium is increased by about 10°–15° C., without reducing the entire cooling effect. Since the extraction fans also constitute the coolant supply of the preceding zone, depending on the number of zones, there is also achieved a corresponding reduction of the entire technical effort involved.

In accordance with the invention, in the case of a cooling system where the annealing material is cooled on its upper surface and on its lower surface, and upper and lower nozzle bars are provided in the corresponding zone, the lower nozzle bar is each connected with the distribution box from the zone succeeding in transport direction of the annealing material, and with the supply of fresh cooling medium, and there is provided an additional collecting fan, which urges the cooling medium originating from the lower nozzle bar into the upper nozzle bar. Of course, the entire zone must be provided with an extraction fan for urging the cooling medium through the distribution box into the preceding zone.

In the drawing, the subject-matter of the invention is schematically represented by way of example, wherein.

Figure 1:
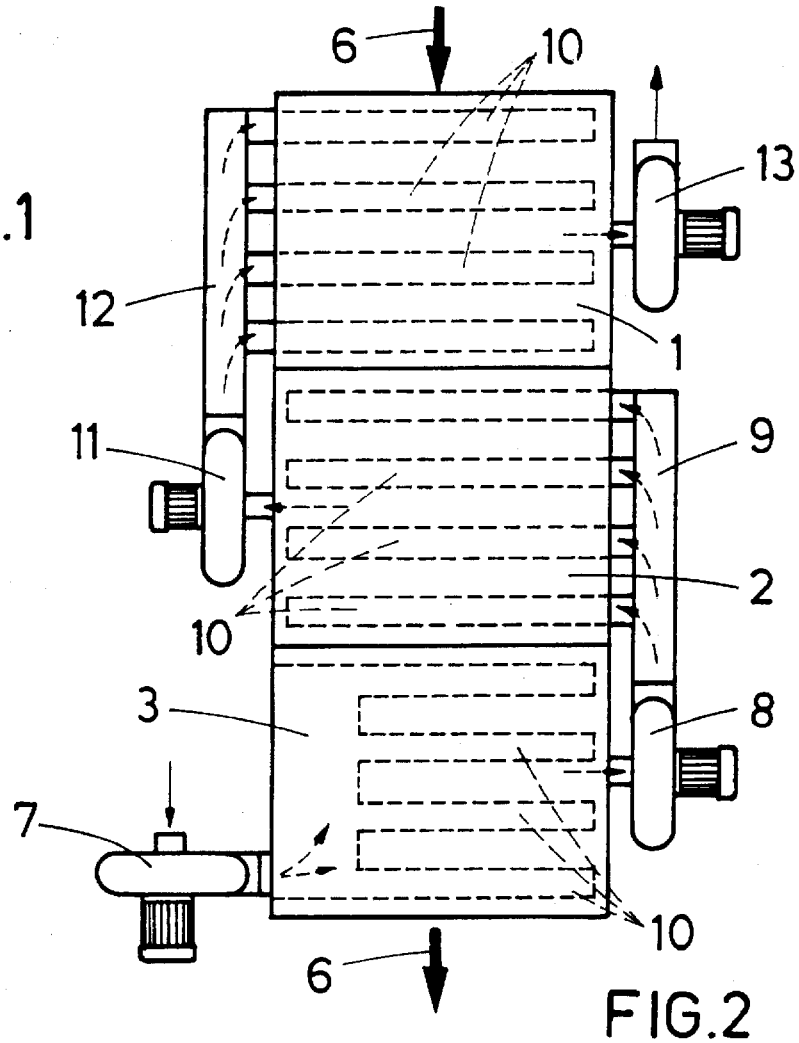
FIG. 1 shows a top view of a cooling system including three zones.

In accordance with FIG. 1, the cooling system consists of three zones 1, 2, 3, through which the annealing material 4 in the form of plates is moved continuously on a transport means consisting of drive rollers 5 (FIG. 2) in the direction of the arrows 6. As cooling medium cold air is used, which through a fan 7 is urged into the last zone 3, i.e. the zone disposed on the outlet end for the annealing material 4. This zone is provided with a collecting fan 8, which urges the cooling medium into a distribution box 9, to which there are connected nozzle bars 10 for the formation of an oblique blast acting on the annealing material 4. The zone 2 likewise comprises a collecting fan 11 with a distribution box 12 for the first zone 1 on the inlet end, from which a collecting fan 13 finally leads to the outside.

Figure 2:
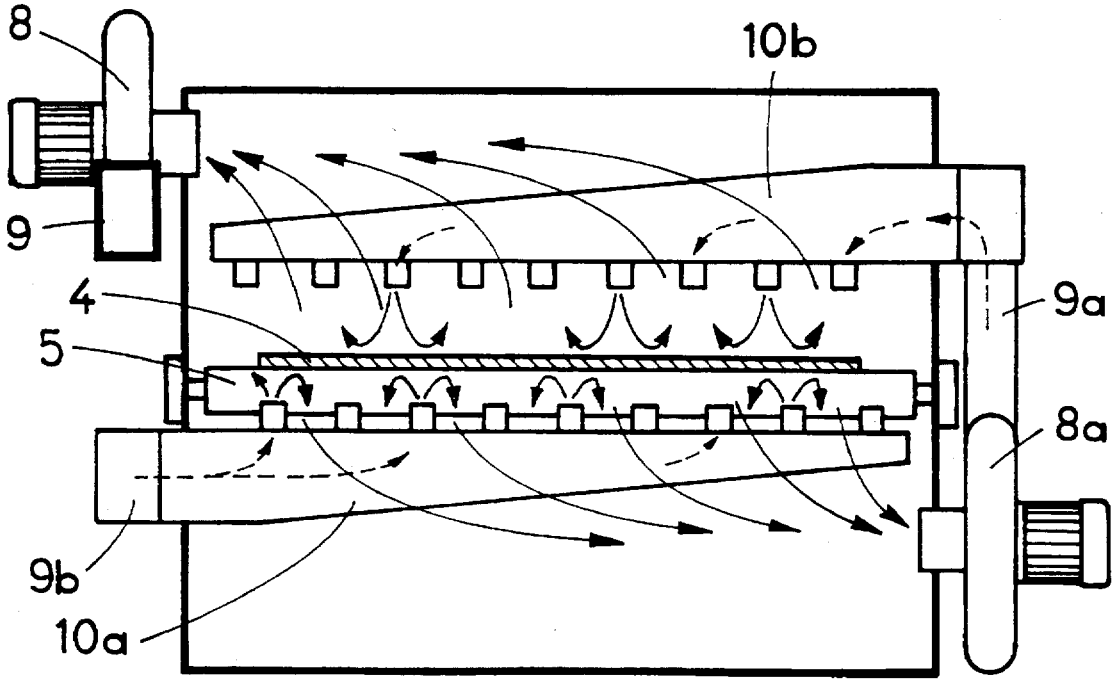
FIG. 2 shows a vertical section through the middle zone on a larger scale.

In accordance with FIG. 2, the invention relates to a cooling system where the annealing material 4 on the drive rollers 5 is cooled on its lower and its upper surface. The cooling medium flows from a distributor **9*a* of the zone arranged subsequently in transport direction into a lower nozzle bar 10*a*, and is supplied by an additional collecting fan 8*a* via a distribution box 9*a* to the upper nozzle bar 10*b*. Both nozzle bars 10*a*, 10*b* are of course provided with deflector nozzles. Upon impingement, the cooling medium emerging from the nozzle bar 10*b* is supplied to the preceding zone via a suction fan 8 and the distribution box 9**.

We claim:

1. A cooling system for annealing material (4) in the form of plates, strips or bulk material continuously moving on a transport means (5), where the cooling system consists of a plurality of zones (1, 2, 3) in which the annealing material (4) is treated on its upper and/or lower surface with an oblique blast of cooling medium in the form of air or gas emerging from nozzles of nozzle bars (10, **10*a*, 10*b*) fed by blowers (7, 8, 8*a*, 11), characterized in that only the last zone (3) disposed on the outlet end for the annealing material (4) is connected to the supply (7) of pressurized fresh cooling medium, and upon formation of the oblique blast a collecting fan (8, 8*a*, 10) is provided for the cooling medium, which urges the cooling medium into a distribution box (9, 9*a*, 12) to which the nozzle bars (10, 10*a*, 10*b*) are connected, which likewise have a collecting fan (8, 11) including a distributor (9) for the preceding zone (2, 1), where this set-up or arrangement is repeated up to the first zone (1) disposed on the inlet end for the annealing material, whose collecting fan (13**) finally leads to the outside.

2. The cooling system as claimed in claim 1, where the zones each comprise lower and upper nozzle bars, characterized in that the lower nozzle bar (**10*a*) is each connected with the distribution box (9*a*) from the zone succeeding in transport direction, and with the supply (7) for fresh cooling medium, and an additional collecting fan (8*a*) is provided for urging the cooling medium originating from the lower nozzle bar (10*a*) into the upper nozzle bar (10*b***).

* * * * *